US009526380B2

(12) United States Patent
Hamilton et al.

(10) Patent No.: US 9,526,380 B2
(45) Date of Patent: Dec. 27, 2016

(54) HAND CLEANING STATION

(71) Applicant: Enforc Hygiene, LLC, Hamilton, OH (US)

(72) Inventors: Drew Hamilton, Hamilton, OH (US); Aaron Spurlock, Hamilton, OH (US)

(73) Assignee: ENFORC HYGIENE, LLC, Hamilton, OH (US)

( * ) Notice: Subject to any disclaimer, the term of this patent is extended or adjusted under 35 U.S.C. 154(b) by 0 days.

(21) Appl. No.: 14/615,138

(22) Filed: Feb. 5, 2015

(65) Prior Publication Data

US 2015/0216369 A1 Aug. 6, 2015

Related U.S. Application Data

(60) Provisional application No. 61/936,722, filed on Feb. 6, 2014.

(51) Int. Cl.

| | |
|---|---|
| ***G08B 23/00*** | (2006.01) |
| ***A47K 5/12*** | (2006.01) |
| ***G08B 21/24*** | (2006.01) |
| ***E03C 1/05*** | (2006.01) |

(52) U.S. Cl.

CPC ..... *A47K 5/1217* (2013.01); *E03C 1/057* (2013.01); *G08B 21/245* (2013.01); *A47K 2210/00* (2013.01); *Y10T 137/9464* (2015.04)

(58) Field of Classification Search

CPC ..... G08B 21/24; G08B 21/245; E05C 1/05; E05C 1/057; Y10T 137/86389; Y10T 137/9464; E03C 1/05; E03C 1/057

USPC ..... 340/573.1; 4/623, 628; 222/52

See application file for complete search history.

(56) References Cited

U.S. PATENT DOCUMENTS

| | | | | |
|---|---|---|---|---|
| 5,199,118 | A | 4/1993 | Cole | |
| 5,765,242 | A * | 6/1998 | Marciano | E03C 1/057 4/623 |
| 5,781,942 | A * | 7/1998 | Allen | G08B 21/245 4/623 |
| 5,954,069 | A | 9/1999 | Foster | |
| 5,966,753 | A * | 10/1999 | Gauthier | E03C 1/055 4/623 |
| 5,979,500 | A * | 11/1999 | Jahrling | E03C 1/057 4/623 |

(Continued)

*Primary Examiner* — John A Tweel, Jr.
(74) *Attorney, Agent, or Firm* — Jenei LLC

(57) ABSTRACT

An apparatus and method to enforce an effective hand washing technique at a wash station. A hand cleanser controller receives a hand cleanser trigger and responds to receiving the hand cleanser trigger by dispensing hand cleanser and transmitting a reset command. A water dispensing device includes a water dispensing trigger component that detects a user's hand proximate to a water faucet. A controller receives a reset command from the hand cleanser device based upon dispensing of a hand cleanser at a wash station, resets a timer in response to receiving the reset command, receives a water dispensing trigger from a water dispensing trigger component, and in response to receiving the water dispensing trigger, actuates the electrically-actuated water valve to dispense water based upon a determination that the timer has expired. Furthermore, the was station may include audio, video or both for use in training, monitoring and advertising presented to the user having to wash their hands for a period of time.

27 Claims, 6 Drawing Sheets

(56) References Cited

U.S. PATENT DOCUMENTS

| | | | | |
|---|---|---|---|---|
| 6,375,038 | B1 * | 4/2002 | Daansen | A47K 5/1217 222/52 |
| 6,549,816 | B2 * | 4/2003 | Gauthier | E03C 1/05 4/302 |
| 6,727,818 | B1 | 4/2004 | Wildman | |
| 7,015,816 | B2 | 3/2006 | Wildman | |
| 7,408,470 | B2 | 8/2008 | Wildman | |
| 7,443,305 | B2 | 10/2008 | Verdiramo | |
| 7,450,024 | B2 | 11/2008 | Wildman | |
| 7,755,494 | B2 | 7/2010 | Melker | |
| 7,812,730 | B2 | 10/2010 | Wildman | |
| 7,898,407 | B2 * | 3/2011 | Hufton | G08B 21/245 340/573.1 |
| 7,978,083 | B2 | 7/2011 | Melker | |
| 8,368,544 | B2 | 2/2013 | Wildman | |
| 8,502,681 | B2 * | 8/2013 | Bolling | G08B 21/245 340/539.1 |
| 8,525,666 | B2 | 9/2013 | Melker | |
| 8,598,996 | B2 | 12/2013 | Wildman | |
| 9,349,267 | B2 | 5/2016 | Wildman | |
| 2006/0132316 | A1 | 6/2006 | Wildman | |
| 2009/0195385 | A1 * | 8/2009 | Huang | G08B 21/245 340/573.1 |
| 2014/0292518 | A1 | 10/2014 | Wildman | |

* cited by examiner

HAND CLEANING STATION

CROSS-REFERENCE TO RELATED APPLICATIONS

This application claims the benefit of priority under 35 U.S.C. §119(e) to U.S. Patent Application Provisional Application Ser. No. 61/936,722 entitled "HAND CLEANING STATION", filed Feb. 6, 2014, the contents of which are hereby incorporated by reference in their entirety.

BACKGROUND OF THE INVENTION

Field of the Invention

The field of art disclosed herein pertains to a water dispensing controller, and more particularly to washing station with controlled water dispensing.

Description of the Related Art

In order to reduce the transfer of pathogens, medical practitioners are required to wash their hands with a hand cleanser and water for a sufficient period of time. Generally, training with reminders by instructional placards must suffice to encourage proper washing. Unfortunately, often certain individuals are not appropriately mindful as to the proper amount of time required to satisfactorily wash their hands to substantially eliminate the pathogens.

BRIEF DESCRIPTION OF THE FIGURES

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
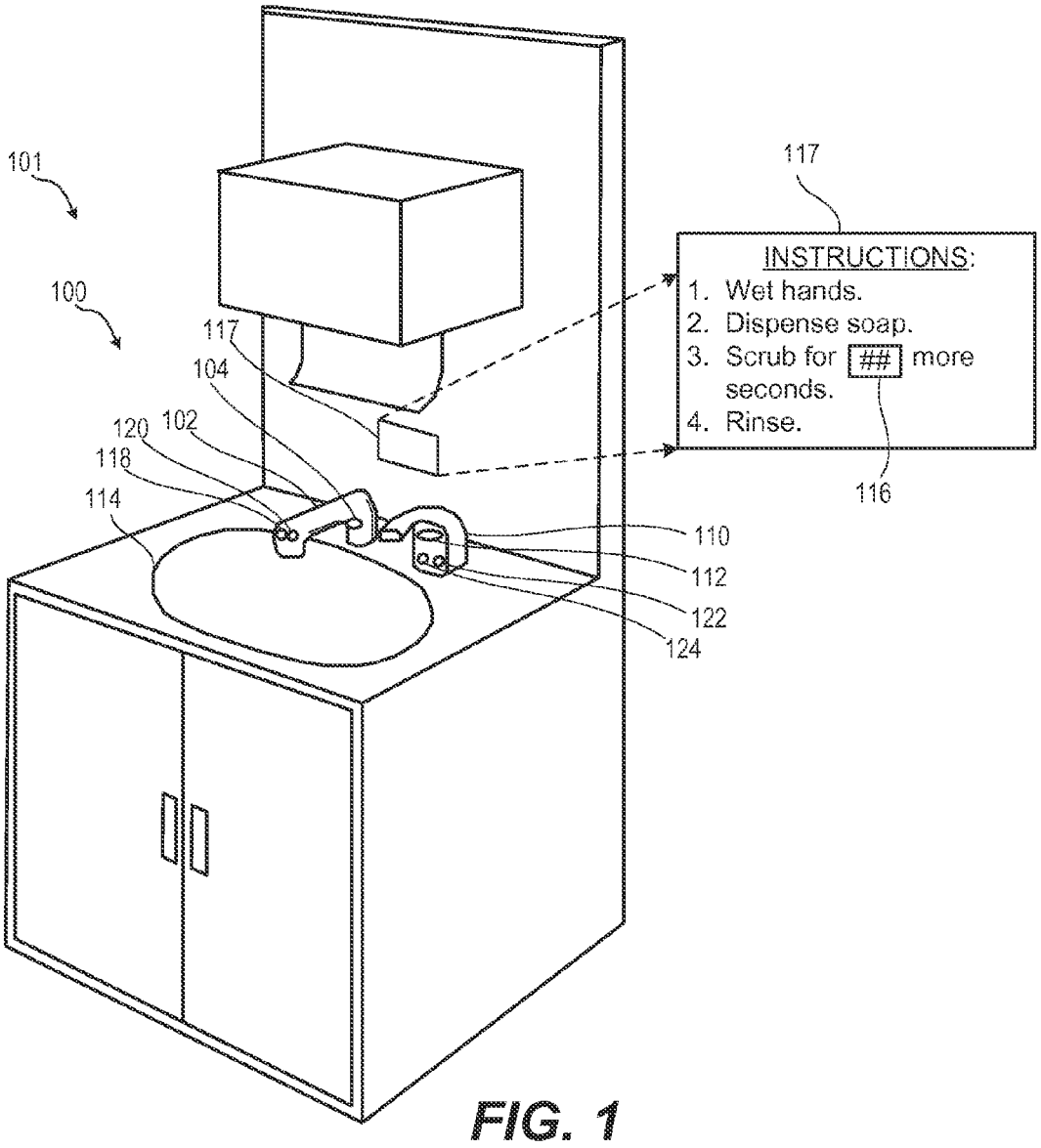
FIG. 1 illustrates an example hand wash station incorporating a hand washing apparatus to enforce a proper hand washing technique, according to one or more embodiments.

The present disclosure provides in one aspect to a method of enforcing an effective hand washing technique. In one embodiment, the method includes receiving a reset command based upon dispensing of a hand cleanser at a wash station, resetting a timer in response to receiving the reset command, receiving a water dispensing trigger, and in response to receiving the water dispensing trigger, dispensing water based upon a determination that the timer has expired.

In one embodiment, the present disclosure provides an apparatus of a wash station to enforce an effective hand washing technique. A water dispensing device includes an electrically-actuated water valve, a timer, a water dispensing trigger component to detect a user's hand proximate to a water faucet, and a controller in communication with the electrically-actuated water valve, the water dispensing trigger component, and a hand cleanser device. The controller receives a reset command from the hand cleanser device based upon dispensing of a hand cleanser at a wash station, resets the timer in response to receiving the reset command, receives a water dispensing trigger from the water dispensing trigger component, and in response to receiving the water dispensing trigger, actuates the electrically-actuated water valve to dispense water based upon a determination that the timer has expired.

In one embodiment, the present disclosure provides a system for enforcing an effective hand washing technique. The system includes a timer, a supply of hand cleanser, a hand cleanser infrared sensor positioned to sense a user's hand placed under the supply of hand cleanser, a hand cleanser electrical actuator, a water dispensing infrared sensor positioned to sense the user's hand placed under a water faucet, a water faucet electrical actuator; and at least one controller. The at least one controller activates the hand cleanser electrical actuator in response to the hand cleanser infrared sensor detecting the user's hand, resets the timer in response to activating the hand cleanser electrical actuator, activates the water faucet electrical actuator in response to determining that the timer is expired and to the water dispensing infrared sensor detecting the user's hand, and inhibiting the water faucet electrical actuator in response to determining that the timer is unexpired.

Turning now to the Drawings, the detailed description set forth below in connection with the appended drawings is intended as a description of various configurations and is not intended to represent the only configurations in which the concepts described herein may be practiced. The detailed description includes specific details for the purpose of providing a thorough understanding of various concepts with like numerals denote like components throughout the several views. However, it will be apparent to those skilled in the art that these concepts may be practiced without these specific details. In some instances, well known structures and components are shown in block diagram form in order to avoid obscuring such concepts.

With initial reference to FIG. 1, a system 100 is designed to aid in the elimination of pathogen transfer due to improper hand washing at a hand washing station 101. Once soap or hand cleanser is dispensed, hands must be scrubbed for a period of time (typically between 20 and 40 seconds) to allow molecules to become water soluble and effectively get removed from hands when rinsed. This system 100 is designed to utilize either hardwired or wireless technology to enforce hand scrubbing for a user-defined time period to help ensure that pathogens do not remain on hands and are allowed to transfer to surfaces or individuals that they then contact. This system 100 will operate with standard or touch-less soap dispensers and touchless faucets. It will effectively allow the two parts of the hand-washing process to be tied together to help to ensure that user is taking adequate time for soap to be effective.

Under normal conditions, an automatic faucet 102 requires a power source and can operate using a number of different power sources. The automatic faucet 102 can draw power from dry-cell batteries or also use a low-voltage current from an alternating current (AC) transformer. If an AC transformer is used, then electricity may power the sensor, control electronics and water valve. Battery-powered faucets may use latching solenoid valves that stay in the open position without further electric current until a spurt of power pushes them back to the closed position. Transformer-powered faucets use continuous electric current to hold the solenoid valve open.

The faucet 102 under normal condition will operate using an infrared sensor 104. When your hands come within a few inches of the lip of the spout, infrared light bounces off your skin to the detector. The faucet sensor 104 typically controls a solenoid-activated diaphragm valve. The solenoid is an electromagnet that can push or pull, depending on electric polarity. Diaphragm valves use a rubber-like disc to control water flow. The valve is normally held closed, but in response to a sensor signal that hands are present, the solenoid pulls the valve open so water can flow out the spout, then pushes the valve closed again when the sensor says the hands are gone.

In one exemplary embodiment, the operation of this hand washing station 101 begins with a soap dispenser 110. The soap dispenser 110 can also be powered using either dry-cell batteries or also use a low-voltage current from an AC transformer. Like the faucet head, when your hands come within a few inches of the lip of the spout, infrared light from a sensor 112 bounces off your skin back to the sensor 112. The sensor 112 signals to a solenoid valve to dispense a predetermined amount of soap or hand cleanser to a user's hand occupying the station. At the same time the sensor 112 sends a signal to a radio frequency (RF) transmitter also located in the soap dispenser 110. This signal is transmitted to the RF receiver in the faucet head.

The receiver in the faucet head will then relay the signal to a circuit board. This board will begin a timer that is preset by customer to a predetermined time. The circuit board will simultaneously send a signal to the infrared sensor in the sink disabling it for the predetermined time set by the customer. This will be the case even if there was an object present in the infrared sensor of a sink 114. The water will still be disabled at that time. At the same time the circuit board will send two additional signals. The first of these is to the screen 116 located near or in the faucet head, such as part of an instruction placard 117. The screen 116 will display a countdown from the predetermined time to zero when then the infrared sensor is again enabled and turn off after the countdown is complete. The second is to the LED light display, depicted as a red LED 118 and a green LED 120, also located on the faucet head changing a normally green light to red for the predetermined amount of time. At any point during the countdown if the infrared sensor in the soap dispenser 110 is activated, the RF signal is resent and the countdown will reset back to predetermined time and the red LED 118 will illuminate. After the countdown the signal will again power the green LED 120 signaling that the faucet head is functioning under normal conditions.

In one exemplary embodiment, the screen 116 may be a liquid crystal diode (LCD) or light emitting diode (LED) monitor. In one exemplary embodiment, the screen 116 may be used for presenting text messages that warn employees and visitors to wash their hands and for displaying video and images. In one exemplary embodiment, the screen 116 may be used for presenting instructions for hand washing. In another exemplary embodiment, the screen 116 may be used for presenting advertisements to users.

The hand washing station 101 may emit an audio message reminding users to wash their hands prior to leaving the restroom. The screen 116 may also display a video message that reminds the patrons to wash their hands, or provide instructions on proper hand washing techniques. The hand washing station 101 may provide either an audio or video message, or both, in combination. In addition, the hand washing station 101 may be configured with motion sensors to activate upon movement, and remain in a dormant or sleep mode when no movement is detected.

In one embodiment the hand washing station 101 may also include a microphone for recording the audio reminder or audio messages. In addition, the hand washing station 101 may be provided with a screen 116 that projects one or more visual cues as a reminder to wash or to provide instructions on proper hand washing techniques. The hand washing station 101 may also be configured with a motion detection device, and include a motion detector, such as for example, an infrared detector.

The hand washing station 101 may also be provided with a communications port, such as for example, a USB port to download applications, audio, video, and other electronic data to the hand washing station 101. The hand washing station 101 may also be provided with wireless communication features such as internet compatibility, in order to receive messages quickly without the need for user download. In addition, in some embodiments, the hand washing station 101 may be provided with additional features, such as a smoke alarm and/or a carbon monoxide detector. The hand washing station 101 may also be configured as a deodorizer or air freshener, and emit an odor-absorbing or odor-masking substance into the atmosphere.

In its most basic form, the hand washing station 101 is configured to emit an audio message to users reminding them to wash their hands. Accordingly, the hand washing station 101 may contain one or more digital recordings that serve as the reminding system. The user of the hand washing station 101 may select from among a collection of more generalized statements prerecorded. Alternatively, the hand washing station 101 may permit users to record their own customized messages, via microphone, to urge users to wash their hands. The hand washing station 101 is capable of playing and recording messages in virtually any language the user desires.

In addition to, or as an alternative to, the audio message, the hand washing station 101 may also provide video displays to remind the user to wash his or her hands, and/or to provide instructions on proper hand washing techniques. In one embodiment, the video clips may be illustrated figures or diagrams only. In another embodiment, the video cues may provide illustrations with text explaining the images. Alternatively, the video cues may be displayed as a short video clip (for example, 10-30 seconds long). In another embodiment, the video display may be a simple text message reading "Please remember to wash your hands." Another use for the video display is to provide advertising or warning messages to users.

The hand washing station 101 may be highly customized to the establishment, as well as to the target audience. The hand washing station 101 may provide the audio/video message in any number of languages, and may have context-specific references to the establishment where the hand washing station 101 is to reside. In a hospital setting, the audio/video messages may reference hospital staff and specific hospital policies, Federal and local regulatory guidelines (e.g., U.S. Occupational Safety and Health Administration (OSHA), Centers for Disease Control and Prevention (CDC), Food and Drug Administration (FDA), etc.), and bylaws.

In accordance with at least one embodiment of the present invention, the hand washing station 101 may access an employee's record to provide custom designed content in conjunction with the user's needs/requests. Accordingly, as one possible alternative to educational or training content, entertainment content specific to the user's preferences may be displayed. Here, other information is conveyed to the user, such as news (e.g., weather, breaking stories, current events, stock prices, etc.) and sports information. The hand washing station 101 may, therefore, accommodate specific requests to convey information of interest to the user. In one embodiment, the content is paid advertising that provides a revenue source.

In some embodiments, the screen 116 may be adapted to display information, audio, video, text, images, and/or the like that can be specified by a client. For example, a default video may display and/or demonstrate one or more proper hand washing techniques. The screen 116 may also be adapted to display real time data, such as stock prices, sport scores, weather information, general advertisements, targeted advertisements, medical educational information, treatment option information, pharmaceutical product information, the number of patients in a hospital or census, the time, and/or the like. The screen 116 may be adapted to display custom content set up by an administrator. In some embodiments, the custom content may depend upon a compliance rating of the user. For example, if a user has a compliance rating below a selected percentage, a training video, or the like, may be displayed to the user. In some embodiments, a user's compliance rating may comprise a percentage that the user complies with a hand hygiene protocol. In some embodiments, the user may be presented with targeted advertisements based on a user profile set up by the user and/or the administrator. For example, a specialist medical professional may be presented with targeted advertisements related to his or her specialty by the screen 116.

In one aspect, low soap or hand cleanser in cartridge condition is detected and communicated. For example, the weight of the soap cartridge is measured under normal conditions. When the weight of cartridge becomes low indicating a low level of soap a signal is sent to a circuit board. The circuit board then sends a signal to a flashing red LED light 122 to indicate low soap. A signal is simultaneously sent disabling the infrared sensor in the soap dispenser. This will mean that even if an object such as a hand is placed in front of the sensor soap will not be dispensed and thus a signal will not be sent to the faucet sensor. The sink will operate under normal conditions. When the cartridge is replaced with a full cartridge the weight sensor will send a signal to the circuit board. The circuit board will then turn off signal to flashing LED light and send signal enabling infrared sensor in soap dispenser.

In an instance where the battery is low in the soap dispenser 110, a signal is sent to the circuit board. A signal is then sent to a flashing yellow LED 124 to indicate low battery. All other functions act under normal conditions until battery is completely dead. In an instance where the battery is low in the faucet a signal is sent to the circuit board. A signal is then sent to a flashing yellow LED 124 to indicate low battery. All other functions act under normal conditions until battery is completely dead.

Figure 2:
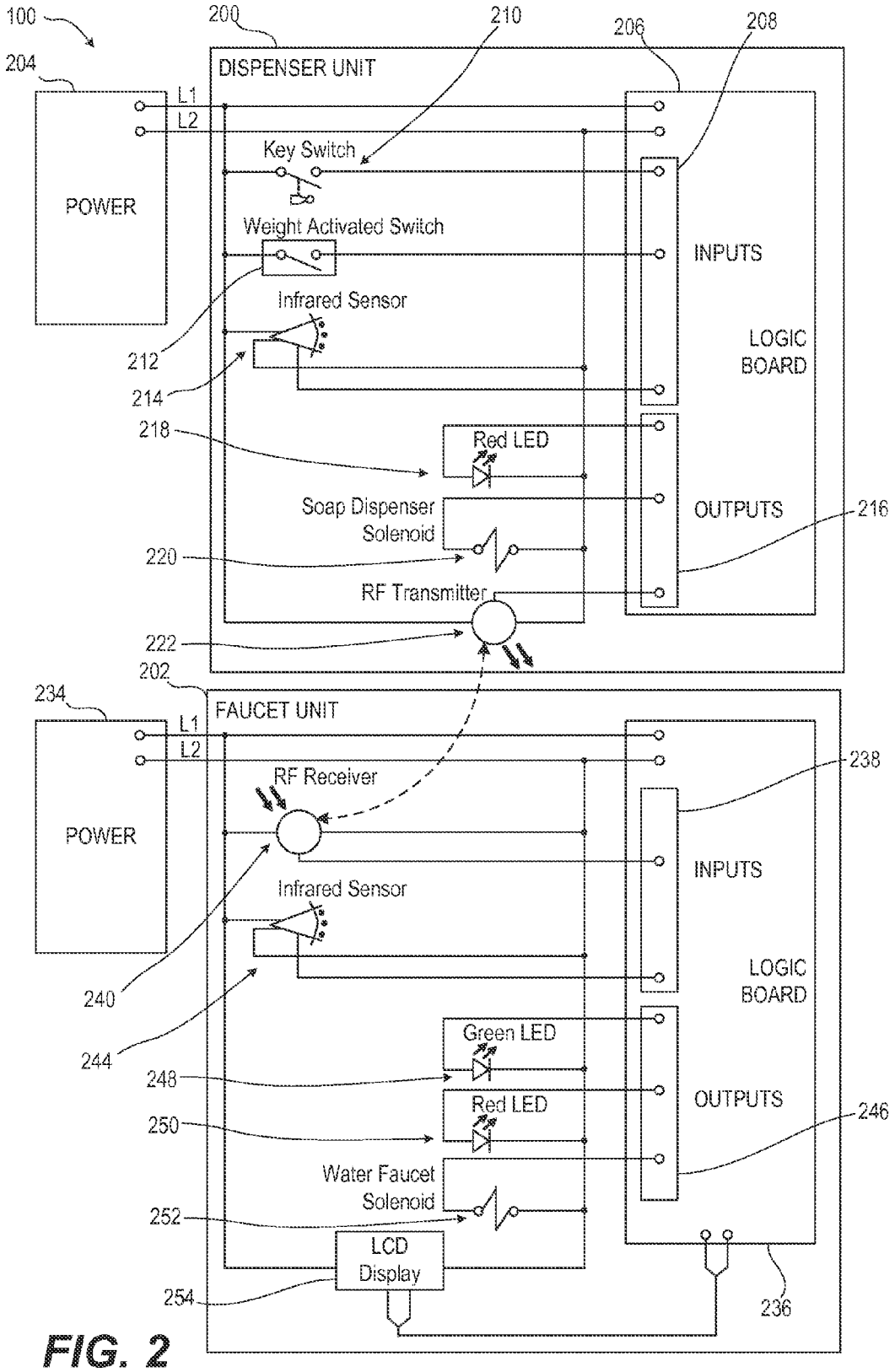
FIG. 2 illustrates a schematic block diagram of a dispenser controller and a faucet controller of the example hand wash station of FIG. 1, according to one or more embodiments.

FIG. 2 illustrates an example system 100 for enforcing an effective hand washing techniques by a separate dispenser unit 200 that wirelessly communicates with a faucet unit 202. The dispenser unit 200 receives electrical power through leads L1, L2 from a power source 204 that is electrically connected to a logic board 206. Inputs 208 of the logic board 206 include a key switch 210 whose other input is connected to lead L1. When open, the key switch 210 is a bypass to prevent the dispenser unit 200 from sending the disable signal to the faucet unit 202. Inputs 208 of the logic board 206 include a weight activated switch 212 whose other input is lead L1. The weight activated switch 212 is input device to detect when the dispenser unit 200 is low in soap or hand cleanser. An infrared sensor 214 is biased by leads L1, L2 and outputs a signal to the inputs 208 of the logic board 206 when a hand is present at the dispenser unit 200.

Outputs 216 of the logic board 206 include a red LED 218 that is also connected to lead L2 and serves as an output device to visually signal that the dispenser unit 200 is low in soap or hand cleanser. Outputs 216 of the logic board 206 include a soap dispenser solenoid 220 that allows soap to flow from the dispenser unit 200. Outputs 216 of the logic board 206 also include an input to an RF transmitter 222 that is biased by leads L1, L2 to serve as an output device that sends the disable signal from the dispenser unit 200 to the faucet unit 202.

The logic board 206 is configured with software, firmware, programmable logic, or discrete logic circuitry to perform operations described herein. For example, the logic board 206 may dispense a measured amount of soap when a hand is placed in front of the infrared sensor 214 by sending a signal to the soap dispenser solenoid 220. The logic board 206 sends a signal to the RF transmitter 222 to disable the water faucet of the faucet unit 202 from allowing water to flow. The weight activated switch 212 sends a signal to the logic board 206 that the dispenser unit 200 is low in soap. The logic board 206 sends a signal to the red LED 218 displaying that the dispenser unit 200 is low in soap. The key switch 210 can be used to disable the dispenser unit 200 from sending the water flow disable signal to the faucet unit 202.

The faucet unit 202 receives electrical power through leads L1, L2 from a power source 234 that is electrically connected to a logic board 236. Inputs 238 of the logic board 236 include an output of an RF receiver 240 that is biased by leads L1, L2 and that serves as an input device to receive the disable signal from the dispenser unit 200. An infrared sensor 244 is biased by leads L1, L2 and outputs a signal to the inputs 238 of the logic board 236 when a hand is present at the faucet unit 202.

Outputs 246 of the logic board 236 include a green LED 248 that is also connected to lead L2 and serves as an output device to visually signal that the faucet unit 202 the faucet is enabled, allowing water to flow. Outputs 246 of the logic board 236 include a red LED 250 that is also connected to lead L2 and serves as an output device to visually signal that the faucet unit 202 is disabled from allowing water to flow. Outputs 246 of the logic board 236 include a water faucet solenoid 252 that is also connected to the lead L2 and serves as an output device to allow water to flow from the faucet unit 202. The logic board 236 provides data to a liquid crystal display (LCD) device 254 that is biased by leads L1, L2. The LCD device 254 acts as input/output device to display the remaining seconds before water will be allowed to flow. For example, the user can input from 20 to 40 seconds delay time. Alternatively, the timer setting may be programmed by the original equipment manufacturer (OEM).

The logic board 236 is configured with software, firmware, programmable logic, or discrete logic circuitry to perform operations described herein. For example, the logic board 236 may control the flow of water by sending a signal to the water faucet solenoid 252. The logic board 236 allows water to flow when an object is placed in front of the faucet infrared sensor 244 as long as the dispenser unit 200 has not been activated. The logic board 236 sends a signal to the green LED 248 when water is allowed to flow. The RF receiver 240 sends a signal to the logic board 236 when it receives a signal from the RF transmitter 222 to disable water flow. The logic board sends a signal to the red LED indicating that water flow has been disabled. The logic board sends a countdown signal to the LCD display indicating how many seconds remain before water will be allowed to flow.

In an exemplary aspect, the system 100 of the dispenser unit 200 and faucet unit 202 may perform one or more of the following operations:

1. Under normal usage the faucet uses the existing infrared or ultrasonic sensor technology to determine when object is present and allows flow of water utilizing a solenoid activated diaphragm valve. This will be useful under normal operation when user would like to perform normal functions such as fill a cup.

2. When the soap dispenser is activated (through either manual or touchless operation) a signal is then sent from the dispenser to the faucet. The on-board circuitry of the faucet disables the solenoid from allowing the flow of water for a period of time selected by end user. In one embodiment, the time period is selected for at least 10, 15, 20, 25, 30, 35, 40, 45, 50, 55, or 60 seconds. Typically this time period would be no less than 20 seconds and no more than 40 seconds although other periods of time may be pre-set. For example, particular hand cleansers may require different lengths of time to be efficacious. In an exemplary embodiment, the time period is user defined. The dispenser transmits to the receiving faucet when soap has been dispensed. This transmission can be performed through hardwiring or through wireless technology.

3. After allotted time set by end user the infrared or ultrasonic sensor in the faucet head will resume normal function and water is allowed to flow.

4. If the soap dispenser is activated at any time within the period in which the faucet sensor is disabled, the signal is resent, the timer will be reset, and faucet sensor will be again disabled from this point for the selected period of time 5. If the soap dispenser is activated at any time while water is flowing, the signal is still sent to the faucet sensor disabling the flow of water for the user defined period of time.

6. If the soap dispenser soap cartridge is low, the soap dispenser is disabled and a red blinking LED on the dispenser indicates low soap. The sensor in the soap dispenser will not be activated so it will not send a signal to the faucet to disable the water valve, thus water will flow as under normal conditions.

Indicators

7. Two indicators assist the operator in knowing when water will be available. They can be separate entities or can be located on the head of the faucet. These will assist user in determining length of time required to scrub hands before water will be dispensed to wash off soap. These will be options of end user available on the product.

a) A digital display timer displays the remaining seconds before water is allowed to flow.

b) A red/green light displays red while the water is inhibited. The light turns green when water is allowed to flow.

8. A blinking red LED or other light indicator on the soap dispenser indicates when the soap cartridge is low.

Figure 3:
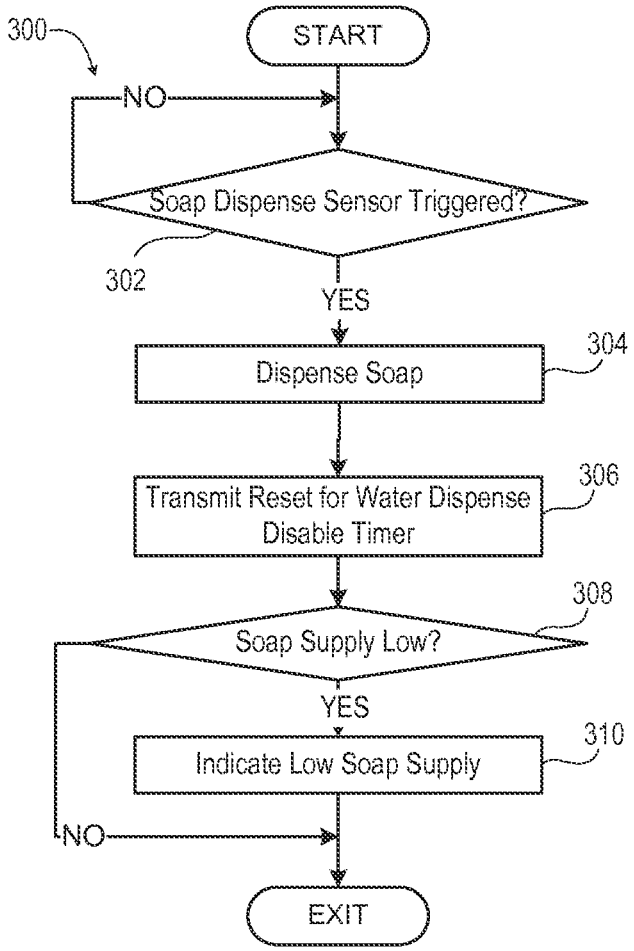
FIG. 3 illustrates a flow diagram of a method of transmitting a reset command by the dispenser controller of FIG. 2 in response to dispensing hand cleanser, according to one or more embodiments.

FIG. 3 illustrates a method 300 of enforcing an effective hand washing technique. In one aspect, the method 300 may include determining in decision block 302 whether a soap dispense sensor has been triggered. For example, a user's hand under a hand cleanser dispenser may be detected by an infrared sensor as being under the dispensing unit. Alternatively, the sensor may detect manual actuation. If soap dispense sensor is determined not to be triggered in decision block 302, then processing repeats decision block 302. If soap dispense sensor is determined to be triggered in decision block 302, then soap is dispensed in block 304. A reset command is transmitted to reset a timer for water dispense disabling (block 306). Then a further determination is made as to whether soap supply is low in decision block 308. If the soap supply is determined to be low in decision block 308, then an indication is given that the supply of soap is low (block 310). Then method 300 exits.

Figure 4:
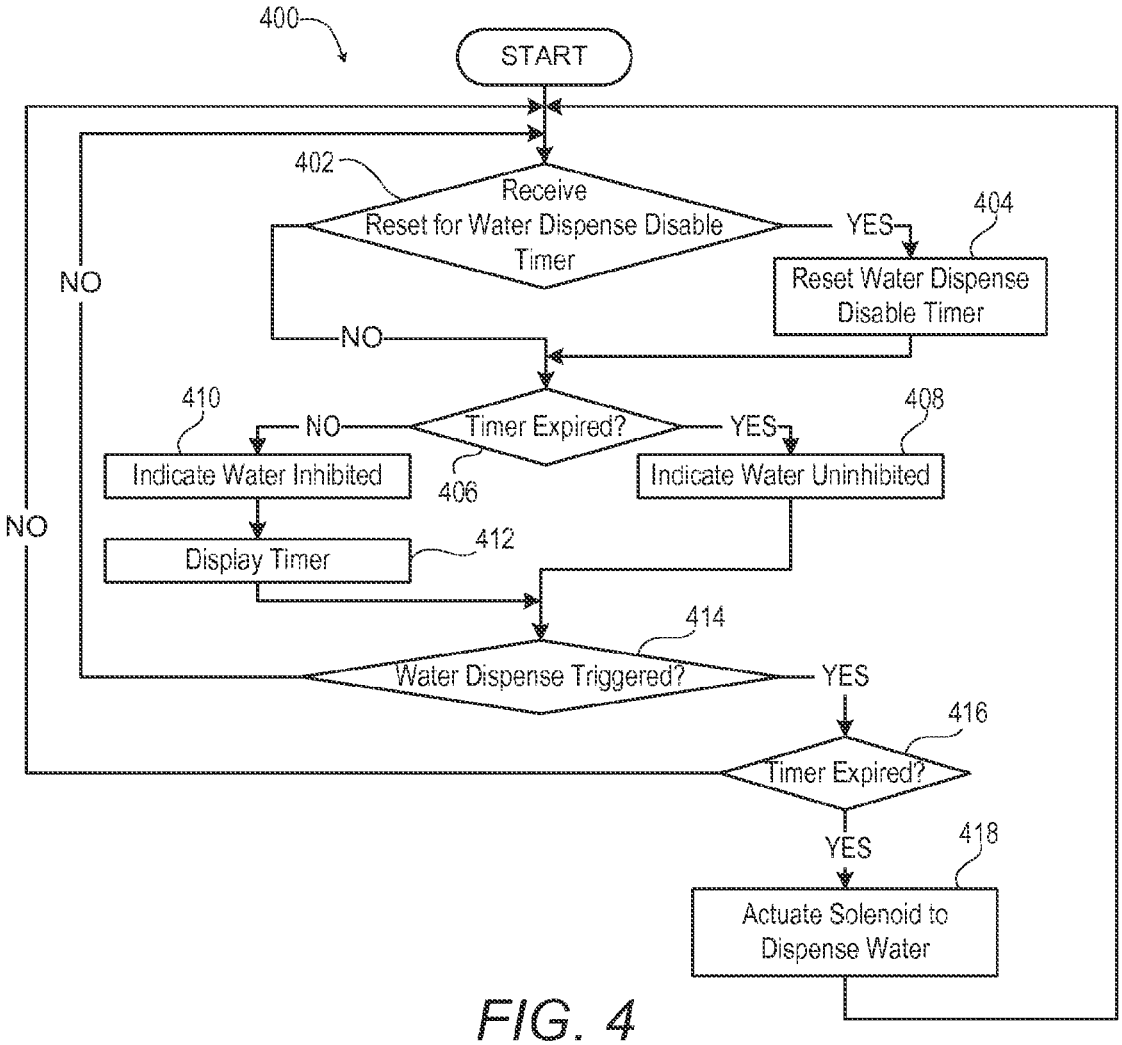
FIG. 4 illustrates a flow diagram of a method of inhibiting dispensing of water by the faucet controller of FIG. 2 for an appropriate period of time following receiving the reset command of the method of FIG. 3, according to one or more embodiments.

FIG. 4 illustrates a method 400 of enforcing an effective hand washing technique. In one aspect, the method 400 may include making a determination in decision block 402 as to whether a reset has been received for a water dispense disable timer. In response to determining that a reset has been received for the water dispense disable timer in decision block 402, then in block 404 the water dispense disable timer is reset, for example, to a value between 20 to 40 seconds. In response to not determining that a reset has been received for the water dispense disable timer in decision block 402 or subsequent to resetting the water dispense disable timer in block 404, then a further determination is made as to whether the timer has expired (block 406). In response to a determination that the timer has expired in decision block 406, then an indication is given that water dispensing is uninhibited (block 408). In response to a determination that the timer has not expired in decision block 406, then an indication is given that water dispensing is inhibited (block 410). In one aspect, the timer is displayed to alert a user as to time remaining for cleansing the hands with the hand cleanser (block 412). Subsequent to block 408 or block 412, a determination is made as to whether water dispensing has been triggered in decision block 414. In response to a determination that water dispensing has not been triggered in decision block 414, then method 400 returns to block 402 to continue monitoring resets of the timer and to indicate an appropriate status of the timer. In response to a determination that water dispensing has been triggered in decision block 414, then a further determination is made as to whether the timer has expired in decision block 416. In response to determining that the timer has not expired in decision block 416, then water dispensing is disabled by returning to block 402 to continue monitoring for reset of the timer and to wait for the timer to expire. In response to determining that the timer has expired in decision block 416, then water is dispensed by actuating the water solenoid (block 418). Then method 400 returns to decision block 402 to continue monitoring for a reset of the timer that would interrupt water dispensing.

Figure 5:
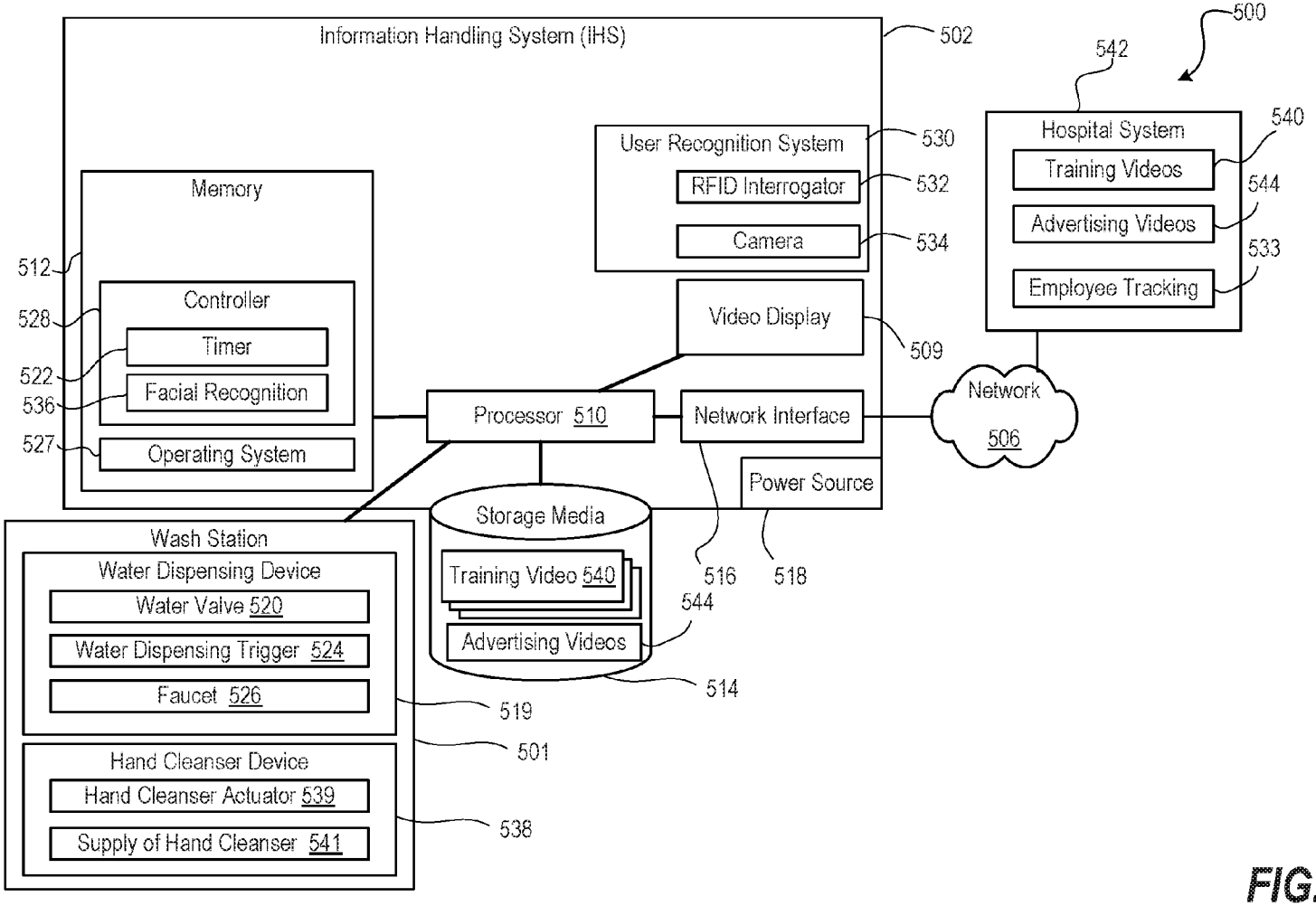
FIG. 5 illustrates a schematic block diagram of a system for imposing a hand washing technique while providing graphical content to a user of a wash station, according to one or more embodiments.

FIG. 5 illustrates a communication system 500 including an information handling system (IHS) 502 for ensuring proper hand cleaning technique over a network 506. A user may use one or a number of hand washing stations 501 that communicate over the network 506. Monitoring users across more than one hand washing stations 501 can provide benefits such as ensuring the appropriate training is provided. For example, a first time user may get a more regimented, step-by-step training guide than a repeat customer that needs more encouragement as to the value of good technique. A very experienced user may ignore the training, so the IHS 502 can instead use this as a captive audience for advertisement presentation for other purposes.

For purposes of this disclosure, an information handling system, such as IHS 502, may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a handheld device, personal computer, a server, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display 509. The information handling system may also include one or more buses operable to transmit communications between the various hardware components.

In a particular embodiment, the IHS 502 includes a processor 510, a memory 512 communicatively coupled to processor 510, storage media 514, a network interface 516 communicatively coupled to processor 510, and a power source 518 electrically coupled to processor 510. Processor 510 may include any system, device, or apparatus configured to interpret and/or execute program instructions and/or process data, and may include, without limitation a microprocessor, microcontroller, digital signal processor (DSP), Application Specific Integrated Circuit (ASIC), or any other digital or analog circuitry configured to interpret and/or execute program instructions and/or process data. In some embodiments, processor 510 may interpret and/or execute program instructions and/or process data stored in memory 512 and/or another component of IHS 502. Memory 512 may be communicatively coupled to processor 510 and may include any system, device, or apparatus configured to retain program instructions and/or data for a period of time (e.g., computer-readable media). By way of example without limitation, memory 512 may include RAM, EEPROM, a PCMCIA card, flash memory, magnetic storage, opto-magnetic storage, or any suitable selection and/or array of volatile or non-volatile memory that retains data after power to IHS 502 is turned off or power to IHS 502 is removed. Network interface 516 may include any suitable system, apparatus, or device operable to serve as an interface between IHS 502 and network 506. Network interface 516 may enable the IHS 502 to communicate over network 506 using any suitable transmission protocol and/or standard, including without limitation all transmission protocols and/or standards enumerated herein with respect to the discussion of network 506.

In one or more embodiments, the IHS 502 of one or more wash stations 501 can include any type, number, and combination of motion sensing devices, cameras, pressure-sensitive floor coverings, distinctive floor areas, electronic sensors, backlit signs, computer monitors, radio frequency identification (RFID) antennas, and other personnel identifying equipment, all coupled to the processor 510 for detecting and identifying people within the patient care room and for determining if and when people entering or leaving the room obtain soap from a soap dispenser. It should be appreciated that although all of the various communication connections are not illustrated, the processor 510 may be connected to every electronic component of the hand washing monitoring system described herein via a wired and/or wireless network. The wash stations 501 may include a server computer, laptop computer, desktop computer, handheld computing device, or any other suitable computer device operative to perform the data collection, processing, and notification functions described herein.

In one or more embodiments, the IHS 502 of one or more wash stations 501 can include the ability to identify the washer, If the user had an UM identification tag, for example, the presence of the RFID could be detected by the processor and added to the record of the wash, or a microphone could detect an audio statement by the user identifying the user and this could be added to the record of the wash, or the image could be examined for visual indicators such as an ID tag or the use of facial recognition or other biometrics. Once the record of the hand washing event is made as described above the record is to be made available to users. This record can be retained for an indefinite period and could serve as evidence of good practices. This can be accomplished by removal of a record media or display on a web page served by the processor or by transmission by WiFi or LAN system in order to connect to a database or remote server.

In one or more embodiments, the IHS 502 of one or more wash stations 501 can include in the processor function a means for downloading the record to a remote server. Because of the difficulty in conforming to unpredictable configuration of firewalls at various locations where this system could be employed, it is advantageous that the capability of downloading should include the capability of tunneling. This has the advantage of record integrity at a more secure location and the ability for further access and analysis by a more powerful machine. The statistics from related systems can be combined by the server, integration into user's reporting systems, the management of secure user access and the generation of report are functions are preferably done by a remote server. More computationally intensive calculations, such as those involved in facial recognition or voice recognition, can be performed in the remote server, offloading chores from the more limited processor in the hand washing system described above. The hand washing server system herein described could perform the functions described as server functions but the increased local system complexity would not be optimal. A feature of the presentation of wash event for review would be the presentation of a single image from all wash events for the period under review to allow further selection of any single wash event and the presentation of the single wash event sped up so that the observation of a wash could be accomplished in a fraction of that time.

In one or more embodiments, the IHS 502 of one or more wash stations 501 can include a water dispensing device 519, an electrically-actuated water valve 520, a timer 522, a water dispensing trigger component 524 to detect a user's hand proximate to a water faucet 526, a controller 528 such as a utility of an operating system 527 executed by the processor 510, and a user recognition system 530 such as including a radio frequency identifier (RFID) interrogator 532 or a camera 534 and facial recognition utility 536 in communication with an employee tracking system 533. The controller 528 in communication with the electrically-actuated water valve 520, the water dispensing trigger component 524; and a hand cleanser device 538 to: (1) receive a reset command from a hand cleanser actuator 539 the hand cleanser device 538 based upon dispensing of a hand cleanser from a supply 541 at the wash station 501; (2) reset the timer 522 in response to receiving the reset command; (3) receive a water dispensing trigger from the water dispensing trigger component 524; and (4) in response to receiving the water dispensing trigger, actuate the electrically-actuated water valve 520 to dispense water based upon a determination that the timer 522 has expired.

The IHS 502 can enhance the training, monitoring and the advertising opportunity presented by the user having to wash their hands for a period of time. To that end, the processor 510 can access training videos 540 from a hospital system 542 over the network 506 or access training videos 540 in storage media 514 for display on video display 509. Alternatively or in addition, the processor 510 can access advertisement videos 544 from the hospital system 542 over the network 506 or access advertisement videos 544 in storage media 514 for display on video display 509.

Figure 6:
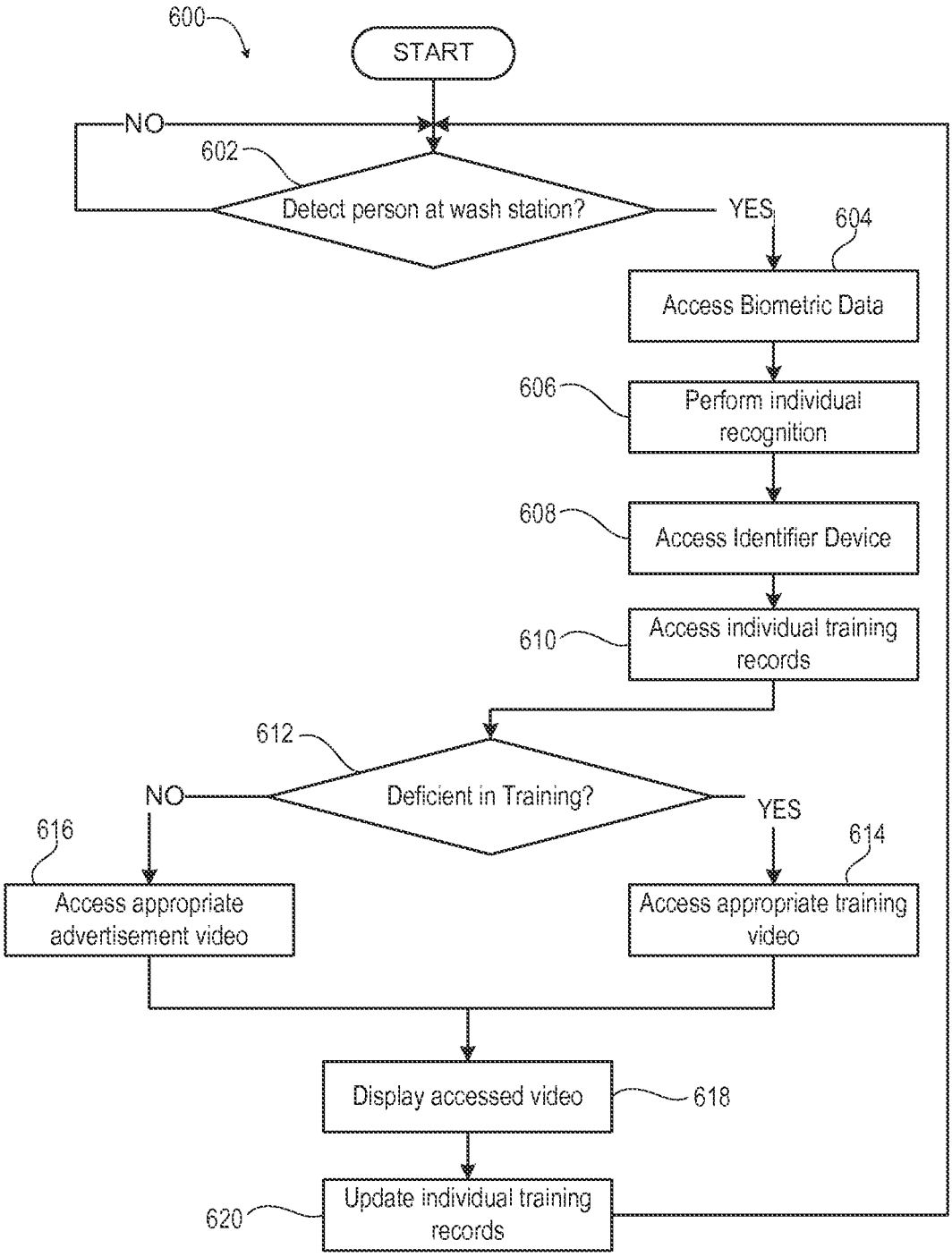
FIG. 6 illustrates a flow diagram of a method of imposing a hand washing technique while providing graphical content to a user of a wash station, according to one or more embodiments.

FIG. 6 illustrates a method 600 for presenting training or ancillary graphical content to a user of wash station during a hand washing technique. A determination is made by the wash station of one or more wash stations whether a person is present (decision block 602). In response to the determination in decision block 602 that a person is not present, the method 600 returns to block 602 to continue waiting for a user. In response to the determination in decision block 602 that a person is present, then an identity of the user is sought. In one embodiment, the wash station accesses biometric data that is actively or passively presented by the user (block 604). For example, the biometric data can be a fingerprint pattern, eye pattern, facial pattern, voice pattern, etc. If provided, the method 600 includes performing individual recognition based upon the biometric data (block 606). Alternatively or in addition, the method 600 includes accessing an identifier device worn or carried by the user (block 608). For example, the user may have a radio frequency identifier (RFID) tag, a cellphone or Wi-Fi device with a unique device identifier, near-field identification device, etc. The method 600 includes accessing individual training records that are associated with the identified individual (block 610). A determination is made in decision block 612 as to whether the identified user is deficient in training based on the number of training opportunities, an elapsed period of time since a training opportunity, or deficient performance in past hand washing technique session, etc. (decision block 612). In response to determining in decision block 612 that the training is deficient, the method 600 includes accessing an appropriate training video (block 614). In response to determining in decision block 612 that the training is not deficient, the method 600 includes accessing an appropriate ancillary video such as for advertisement purposes (block 616). After accessing graphic content in either block 614, 616, the method includes displaying the accessed graphical content such as a video (block 618). The individual training records are updated (block 620). Then method 600 returns to decision block 602 to await another user.

In some embodiments, alerts may be generated when a user did not comply with a predetermined hygiene protocol. The alerts may be real-time, accessed on-demand, may be generated at predetermined time intervals, and/or may be indicated on reports generated by the system on predetermined dates. The alerts, or the like, may be printed in a report, displayed on a computer screen via an interface, or the like, transmitted via email, transmitted via text message, and/or stored in a database in accordance with embodiments of the present invention.

For clarity, touchless activation of soap dispensing and water dispensing are described herein; however, embodiments consistent with the present innovation may employ manual soap dispensing or manual water activation. The state of such dispensing may be detected rather than automatically controlled. For example, a user may turn a faucet knob that would cause water to dispense but for a shutoff solenoid valve controlled by the faucet unit. Similarly, the soap dispenser may be manually actuated with dispensing detected based on a sensor in the handle or a flow sensor, for example.

In the above described flow chart, one or more of the methods may be embodied in a computer readable device containing computer readable code such that a series of functional processes are performed when the computer readable code is executed on a computing device. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. Computer program code for carrying out operations for aspects of the present disclosure may be written in any combination of one or more programming languages, including an object oriented programming language, without limitation. These computer program instructions may be provided to a processor of a general purpose computer, special purpose computer, such as a service processor, or other programmable data processing apparatus to produce a machine, such that the instructions, which execute via the processor of the computer or other programmable data processing apparatus, performs the method for implementing the functions/acts specified in the flowchart and/or block diagram block or blocks.

All publications, patents and patent applications cited herein, whether supra or infra, are hereby incorporated by reference in their entirety to the same extent as if each individual publication, patent or patent application was specifically and individually indicated as incorporated by reference. It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein, will only be incorporated to the extent that no conflict arises between that incorporated material and the existing disclosure material.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A method of enforcing an effective hand washing technique, comprising:

identifying a user of a selected wash station of more than one wash station;

accessing information in an employee tracking system associated with the user regarding one or more prior hand washing sessions on at least another one of the more than one wash station;

selecting and displaying graphical content to the user in response to the information;

receiving a reset command based upon dispensing of a hand cleanser at the wash station;

resetting a timer in response to receiving the reset command;

receiving a water dispensing trigger; and in response to receiving the water dispensing trigger, dispensing water based upon a determination that the timer has expired.

2. The method of claim 1, further comprising:

determining whether the timer is expired;

indicating a current value of the timer;

indicating whether dispensing of water is inhibited based upon the determination of the timer, and resetting the timer to a user defined value in response to receiving the reset command.

3. The method of claim 2, further comprising accessing information in a networked employee tracking system associated with the user and selectin and displaying custom designed graphical content to the user in response to the information.

4. The method of claim 3, wherein the graphical content is selected based in conjunction with re-selected preferences by the user.

5. The method of claim 4, further comprising:

receiving a hand cleanser trigger; and in response to receiving the hand cleanser trigger, dispensing hand cleanser and transmitting the reset command.

6. The method of claim 5, further comprising receiving the hand cleanser trigger by detecting a user's hand under a hand cleanser dispenser.

7. The method of claim 5, further comprising receiving the hand cleanser trigger by detecting a manual actuation of the hand cleanser dispenser.

8. The method of claim 4, further comprising:

determining whether a supply of hand cleanser at the wash station is below a threshold; and indicating the low supply in response to the determining the supply is below the threshold.

9. The method of claim 4, further comprising:

interrupting water dispensing in response to receiving the reset command.

10. The method of claim 4, wherein identifying the user further comprises one of detecting a unique identifier carried by the user and performing facial recognition of the user.

11. An apparatus of a wash station to enforce an effective hand washing technique, comprising:

a water dispensing device, comprising:

an electrically-actuated water valve;

a timer;

a water dispensing trigger component to detect a user's hand proximate to a water faucet;

a network interface in communication with an employment tracking system that receives usage information at least one wash station; and a controller in communication with the electrically-actuated water valve, the water dispensing trigger component; and a hand cleanser device to:

identify a user of a selected wash station;

accessing, in the employee tracking system, information associated with the user regarding one or more prior hand washing sessions on at least one of the wash stations regarding one or more prior hand washing sessions;

select and display graphical content to the user in response to the information;

receive a reset command from the hand cleanser device based upon dispensing of a hand cleanser at a wash station, reset the timer in response to receiving the reset command, receive a water dispensing trigger from the water dispensing trigger component, and in response to receiving the water dispensing trigger, actuate the electrically-actuated water valve to dispense water based upon a determination that the timer has expired.

12. The apparatus of claim 11, further comprising accessing information in a networked employee tracking system associated with the user and selecting and displaying custom designed graphical content in conjunction with pre-selected preferences by the user.

13. The apparatus of claim 12, further comprising accessing information in an employee tracking system associated with the user regarding one or more prior hand washing sessions on at least one other wash station and selecting and displaying graphical content to the user in response to the information.

14. The apparatus of claim 13, further comprising a first indicator, wherein the controller is further to determine whether the timer is expired, and to cause the indicator to indicate whether dispensing of water is inhibited based on the determination of the timer wherein the controller is further to reset the timer to a user defined value in response to receiving the reset command and further comprising a second indicator to indicate a current value of the timer.

15. The apparatus of claim 14, further comprising:

a hand cleanser controller to:

receive a hand cleanser trigger, and in response to receiving the hand cleanser trigger, dispense hand cleanser and transmit the reset command.

16. The apparatus of claim 15, further comprising an infrared sensor to act as the hand cleanser trigger by detecting a user's hand under a hand cleanser dispenser.

17. The apparatus of claim 13, further comprising a flow sensor to act as the hand cleanser trigger by detecting a manual actuation of the hand cleanser dispenser.

18. The apparatus of claim 14, further comprising:

a third sensor to determine whether a supply of hand cleanser at the wash station is below a threshold; and a third indicator to indicate the low supply in response to the determining the supply is below the threshold.

19. The apparatus of claim 18, wherein the water dispensing controller is further to interrupt water dispensing in response to receiving the reset command.

20. A system for enforcing an effective hand washing technique comprising:

an employee tracking system;

more than one wash station, each wash station comprising an apparatus to enforce an effective hand washing technique, each apparatus comprising:

a timer;

a supply of hand cleanser;

a hand cleanser infrared sensor positioned to sense a user's hand placed under the supply of hand cleanser;

a hand cleanser electrical actuator;

a water dispensing infrared sensor positioned to sense the user's hand placed under a water faucet;

a water faucet electrical actuator;

a network interface in communication with the employment tracking system that receives usage information from the more than one wash station; and at least one controller to:

identify a user of a selected wash station of more than one wash station;

accessing, in the employee tracking system, information associated with the user regarding one or more prior hand washing sessions on at least another one of the more than one wash station regarding one or more prior hand washing sessions;

select and display graphical content to the user in response to the information;

activate the hand cleanser electrical actuator in response to the hand cleanser infrared sensor detecting the user's hand;

reset the timer in response to activating the hand cleanser electrical actuator;

activate the water faucet electrical actuator in response to determining that the timer is expired and to the water dispensing infrared sensor detecting the user's hand; and inhibiting the water faucet electrical actuator in response to determining that the timer is unexpired.

21. The system of claim 20, further comprising:

a weight activated switch responsive to the supply of hand cleanser being below a weight threshold; and a low hand cleanser indicator to illuminate in response to the weight activated switch; and at least one indicator to indicate whether the timer is expired.

22. The system of claim 20, further comprising:

a user identification system to identify of a user of the wash station;

a user tracking system to identify training associated with users;

a video display presented to the user of the wash station;

a memory that contains graphical content;

a controller in communication with the user identification to receive user identification of a selected user, in communication with the user tracking system to select graphical content in the memory that is appropriate for the selected use; and to display the selected graphical content to the selected user on the video display.

23. The system of claim 22, wherein the user identification system comprises a biometric reader.

24. The system of claim 22, wherein the user identification system comprises a radio frequency identification interrogator.

25. A method of enforcing an effective hand washing technique, comprising:

identifying a user of at least one selected wash station;

accessing information in a networked employee tracking system associated with the user regarding one or more prior hand washing sessions on at least one or more wash station and pre-selected preferences by the user;

selecting and displaying graphical content to the user in response to the information;

receiving a reset command based upon dispensing of a hand cleanser at the wash station;

resetting a timer in response to receiving the reset command;

receiving a water dispensing trigger; and in response to receiving the water-dispensing trigger, dispensing water based upon a determination that the timer has expired.

26. The method of claim 25, further comprising:

determining a number of times that the user has been trained in effective hand washing technique on any of the washing stations;

in response to determining that the number of times is less than a first threshold, selecting and displaying graphical content comprising a regimented, step-by-step training guide;

in response to determining that the number of times is equal to or greater than the first threshold, selecting and displaying graphical content comprising encouragement as to the value of good technique.

27. The method of claim 26, further comprising:

in response to determining that the number of times is equal to or greater than a second threshold that is greater than the first threshold, selecting and displaying graphical content comprising advertisement presentation.

* * * * *